US005978989A

United States Patent [19]

Chavez

[11] Patent Number: 5,978,989

[45] Date of Patent: Nov. 9, 1999

[54] FLEXIBLE PATIENT TRANSPORTER WITH FOOT POCKET

[76] Inventor: Manuel Garcia Chavez, 2126 LaMonte La., Houston, Tex. 77018

[21] Appl. No.: 09/014,985

[22] Filed: Jan. 28, 1998

[51] Int. Cl.[6] ..... A61G 1/013; A61G 1/04; A61G 1/044; A61G 1/048

[52] U.S. Cl. ..... 5/627; 5/625; 294/77; 294/140; 294/152

[58] Field of Search ..... 5/627, 625, 628; 294/140, 152, 77

[56] References Cited

U.S. PATENT DOCUMENTS

| | | | |
|---|---|---|---|
| 2,279,694 | 4/1942 | Martinson | 5/627 |
| 2,440,712 | 5/1948 | Bickel | 294/77 |
| 2,489,828 | 11/1949 | Springer | 5/625 |
| 2,749,957 | 6/1956 | Smith | 294/77 |
| 2,788,530 | 4/1957 | Ferguson | 5/628 |
| 2,813,745 | 11/1957 | Frieder et al. | 294/77 |
| 3,158,875 | 12/1964 | Fletcher | 5/627 |
| 4,124,908 | 11/1978 | Burns | 5/82 R |
| 4,442,557 | 4/1984 | Clemens | 5/82 R |
| 4,723,327 | 2/1988 | Smith | 5/625 |
| 5,121,514 | 6/1992 | Rosane | 5/628 |
| 5,214,813 | 6/1993 | Gastle et al. | 5/625 |
| 5,333,335 | 8/1994 | Gastle et al. | 5/625 |
| 5,701,619 | 12/1997 | Ullman | 5/625 |

FOREIGN PATENT DOCUMENTS

| | | | |
|---|---|---|---|
| 199309 | 2/1958 | Austria | 294/152 |
| 505103 | 8/1954 | Canada | 5/627 |
| 2672 | 10/1918 | Netherlands | 5/627 |
| 468336 | 7/1937 | United Kingdom | 5/624 |
| 549864 | 12/1942 | United Kingdom | 5/628 |

OTHER PUBLICATIONS

"Man—S.A.C."Product Brochure, 2 pages.

Takashima U.S.A, Rhino Tex Product Specification Sheets, 2 pages.

Value Vinyls, Product Specification Sheets, 3 pages.

*Primary Examiner*—Alexander Grosz

*Attorney, Agent, or Firm*—Wendy K. Buskop; Bayko Gibson et al

[57] ABSTRACT

A flexible patient transporter including an oblong PVC fabric sheet having two substantially parallel side edges and two substantially curved end edges. An edge reinforcing web is attached to the sheet with monofilament stitching so that it extends substantially around all edges of the sheet. A pair of end handles is attached to each of the curved end edges of the sheet and a plurality of side handles attached to the side edges of the sheet. Each of the handles is equally spaced around the perimeter of the sheet and includes a PVC tube with a strap extending through the tube and attached at each end to an edge of said sheet. A loop is attached near an apex of at least one of the end edges, and at least one fastener, is secured to each of the side edges of the sheet, said fasteners being adapted to be releasably secured to at least one of the loops, to thereby form a foot pocket at an end of the sheet, which pocket would prevent a patient from sliding out of the transporter.

20 Claims, 5 Drawing Sheets

FLEXIBLE PATIENT TRANSPORTER WITH FOOT POCKET

BACKGROUND OF THE INVENTION

1. Field of the Invention

The present invention generally relates to beds, and, more particularly, to foldable field stretchers.

2. Description of Related Art

It is well known that simple field stretchers formed from canvas stretched between two parallel, rigid shafts can be used for carrying sick, wounded, or dead persons from remote locations in the field. For example, U.S. Pat. No. 4,124,908 discloses a rescue and transportation device which includes breakaway poles extending through slots formed on opposite sides of a flexible bottom. Although such poles can help evacuation workers to lift and support the patient during transport, they also make the device more difficult to store and maneuver in crowded or restricted areas. U.S. Pat. No. 5,701,619 discloses a stretcher with similar drawbacks formed from a cellular plastic material with internal channels under the patient for holding longitudinal glass-reinforced plastic stiffening elements.

U.S. Pat. No. 4,723,327, on the other hand, discloses a patient mover without rigid supports having an integral, one-piece, continuous handle strap that extends around a channel in the perimeter of a rectangular sheet. The handle strap is accessible at each of the four corners of the sheet and is self-adjusting to the patient's position and the carriers' needs. However, since the handles move relative to the patient, this design can be unstable. U.S. Pat. No. 5,214,813 discloses another rectangular stretcher with reinforced handhold patches at each comer that include folded flaps for protecting users' hands. However, such stretchers do not always provide adequate support beneath the patient.

U.S. Pat. No. 5,121,514 discloses a rectangular emergency support device with increased rigidity in its weight-bearing portion which includes a unitary, or segmented, support layer of polymeric sheeting. The support layer warps slightly from side to side but resists enveloping or imposing radially directed compression forces on the patient. Hand grips are formed on the device by a length of nylon strapping extending axially through parallel loops on each side of the device.

SUMMARY OF THE INVENTION

The present invention provides a one-piece patient transporter with no removable parts that could otherwise be easily lost in the field. The transporter is flexible for easy maneuvering around corners and through small openings. It is also collapsible, foldable, and rollable for easy and compact storage. It is lightweight, yet capable of carrying heavy loads which are comfortably and evenly distributed to each of the handlers.

The transporter includes at least one PVC fabric sheet having two substantially parallel side edges and two substantially curved end edges. An edge reinforcing web, or other reinforcement, may be attached to the sheet with monofilament stitching so that the reinforcing extends substantially around all edges of the sheet. The transporter also includes a pair of end handles attached to each of the curved end edges of the sheet and a plurality of side handles attached to the side edges of the sheet. Each of the handles may be equally spaced around the perimeter of the sheet and include a strap extending through a PVC tube, or other suitable gripping means, and attached to an edge of said sheet at each end.

Each of the end handles is arranged diagonally, or catercornered, to an end handle on an opposite side of an opposite end of the sheet such that crisscrossed end handle reinforcing webs extend between end handles on opposite ends and opposite sides of the sheet. Side handle reinforcing webs are also attached to the sheet and extend, substantially parallel to each other, between side handles on each side edge of the sheet.

The transporter may also include closure clips or fasteners attached at various points around the edges of the sheet and closure rings attached near an apex of each of the top and bottom edges of the sheet. The closure clips and rings may be fastened together at one end to create pockets which fold over the end of the patient and prevent the patient from sliding out of the transporter. Closure straps may be attached to a surface of the sheet, near each of the closure rings, for engaging the nearest closure ring when the transporter is rolled in order to maintain the transporter in a tightly rolled configuration for storage.

BRIEF DESCRIPTION OF THE DRAWINGS

The preferred embodiments of the invention will now be described, by way of example, with respect to the attached drawings where reference numerals have been used to identify the same features in each figure ("FIG.")

DESCRIPTION OF THE PREFERRED EMBODIMENTS

Figure 1:
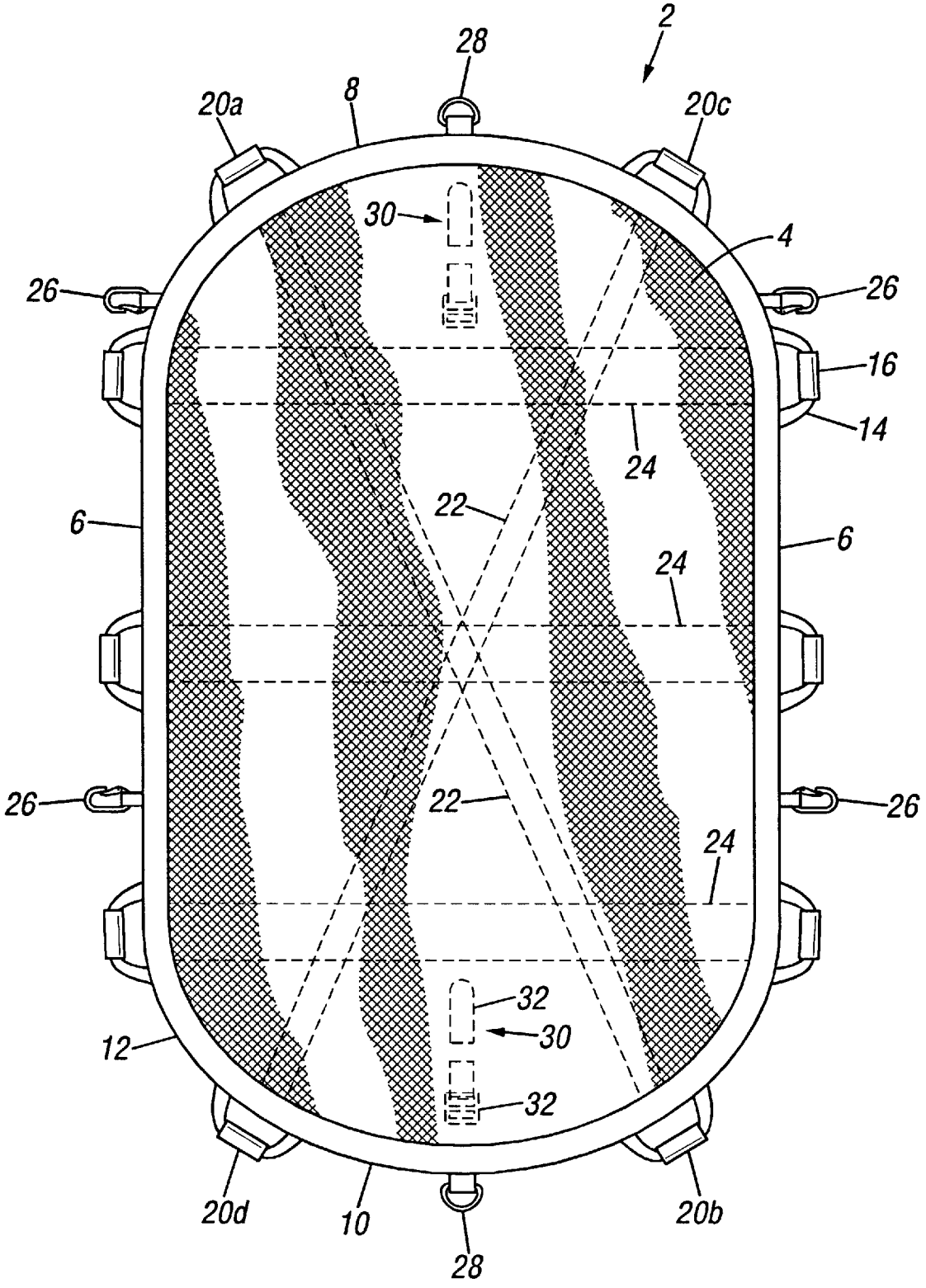
FIG. 1 is a top view of a flexible patient transporter.
Figure 2:
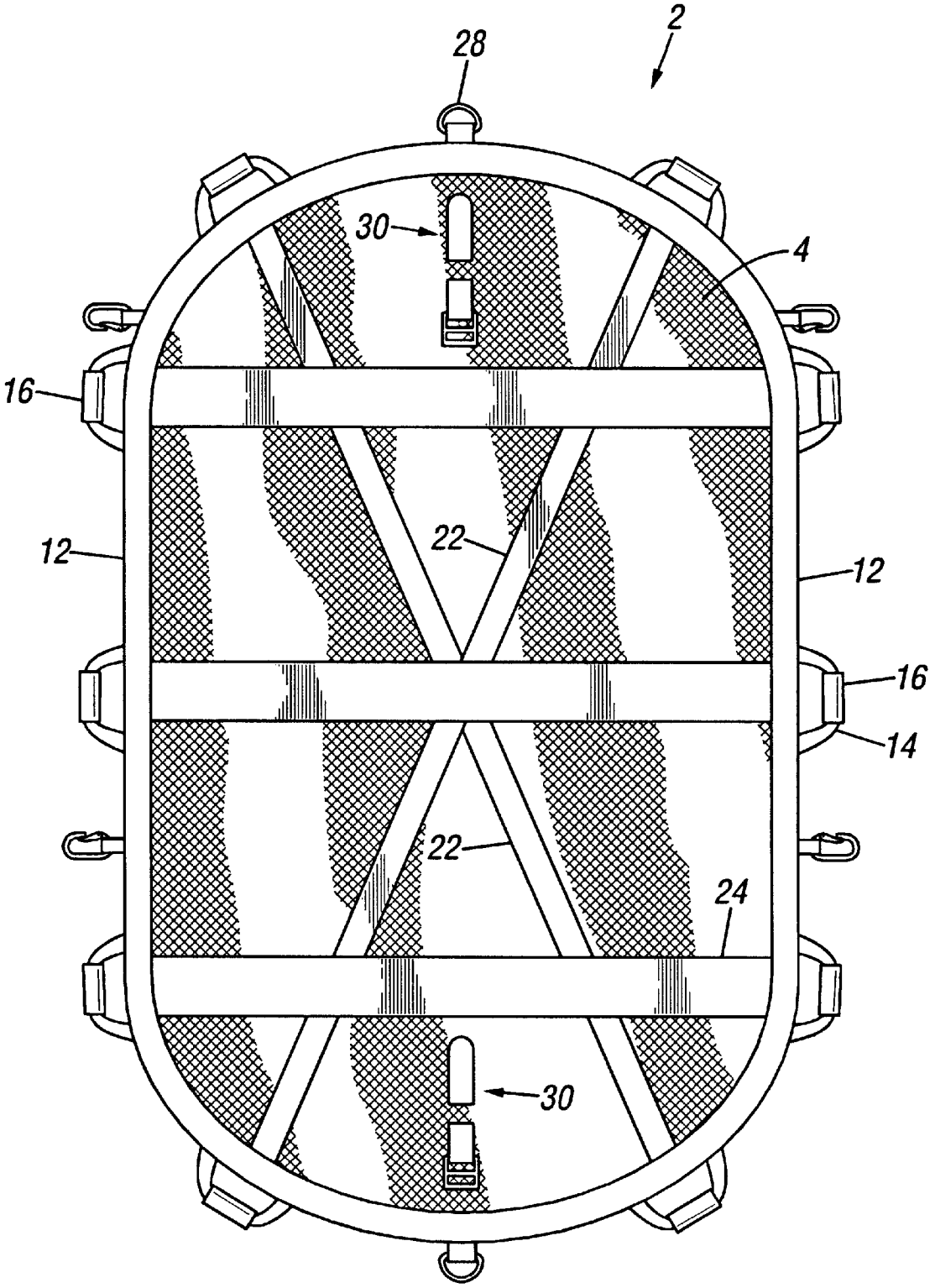
FIG. 2 is a bottom view of the patient transporter of FIG. 1.

FIG. 1 illustrates a top view of one embodiment of an innovative patient transporter 2 which may be used to transport humans, animals (such as dolphins), or other loads, and is especially suitable for very heavy or obese patients. The patient transporter 2 includes a substantially non-rectangular sheet 4 having substantially parallel side edges 6, a curved top edge 8, and a curved bottom edge 10. "Nonrectangular" in this context refers to generally oblong, oval, elliptical, and/or egg-shaped. Although the side edges 6 are illustrated in the figures as being substantially straight and parallel, the side edges may also have a radius of curvature which is substantially larger (or infinite for a configuration with straight side edges) than the radius of curvature for the top and/or bottom edges 8 and 10, respectively. The radius of curvature may also gradually change around the perimeter of the transporter 2. Also, the radius of curvature of the top and bottom edges 8 and 10 is not necessarily the same. One of the end edges 8 and 10 may have such a large curvature radius that it is essentially perpendicular to the side edges 6 so as to form a substantially rectangular end.

As discussed in more detail below with respect to FIG. 6, the non-rectangular oblong, elliptical, or oval shape of the sheet 4, and especially the curvature along at least one of its top or bottom ends, enhances patient comfort by providing an essentially unobstructed peripheral field of view for the patient being transported. A particular advantage of this shape is to provide head support without interfering with an intubated patient's airway. This shape also allows handlers to more easily observe the patient's facial expressions and corresponding vital signs during transport.

The sheet 4 is preferably seven feet long and three and a half to four and a half feet wide. However, other dimensions may also be used with the same ratio of length to width, or a length to width ratio of approximately 2 to 1. A larger sheet may be nine feet long and five feet wide, or other dimensions, with a corresponding ratio of length to width. These dimensions have been found to be most suitable for transporting large, heavy, and/or obese patients.

The sheet 4 may be formed from a canvas, plastic, vinyl, polyvinyl, composite, or other suitable material. The preferred sheet material is strong, flexible, non-conductive, fire-retardant, waterproof, easy to clean, and impervious to bodily fluids so that it can be used in a wide variety of environments. The sheet 4 is preferably formed from a PVC fabric, such as Rhino-Tex™ Product Nos. 1920 61 or 1802 (or their equivalents) vinyl-coated polyester fabrics available from Takashima U.S.A., Inc. of Garden Grove, Calif. Eighteen-ounce fire-retardant laminates and nineteen-ounce coated vinyls, such as those available from Value Vinyls in Arlington, Tex. may also be used.

The edges of the sheet 4 are reinforced with an edge reinforcing web 12 extending continuously around the top, bottom, and side edges of the sheet 4 for preventing tearing or other damage to the edges of the sheet. The edge reinforcing web 12 is preferably a nominal two (1-⅞ to 1-15/16) inches wide, folded over the edges of the sheet 4, and secured to the sheet using a non-absorbent stitching, such as a monofilament or polymonofilament thread. Other conventional means for securing the edge reinforcing web 12 to the sheet 4 may also be used. The edge may also be reinforced by other conventional means such as by ribbing or folding and stitching extra fabric over the edges of the sheet 4.

The webs are preferably formed from an aftermarket polyester seat belt webbing material, or other suitable material, tested to around 5000 pounds with approximately 15% maximum elongation, such as Product No. 575 132, T 1200 (or equivalents) from Narricot Industries, Inc. of Philadelphia, Pa.

Ten handles 14 are preferably evenly spaced around the perimeter of the sheet 4; however, any other number of handles may also be used in any arrangement around the perimeter of the sheet 4. The handles 14 are preferably formed from strips of material similar to the edge reinforcing web 12 and are secured at each end to the edges of the sheet 4 and/or the edge reinforcing web. The handles 14 are preferably secured to the sheet with monofilament or polymonofilament stitching at each end. However, other conventional means for securing the handles to the sheet 4 and/or edge reinforcing web 12 may also be used, such as riveting or fusion bonding.

Each handle 14 includes a grip 16 for providing a relatively uniform and straight gripping surface on the handle. The grips 16 are preferably formed from a stiff tubular material which is as long as the width of a typical hand, and through which the flexible handle strips can be threaded before being attached to the sheet 4 and/or edge reinforcing web 12. The grips 16 are preferably formed from ⅛–¾ inch, but preferably ½ inch, nominal inside diameter PVC tubing which is approximately 2½–5 inches, but preferably 4 inches, long. The grips 16 may also include a cushioning material for providing additional comfort to the users.

The handles 14 can be categorized as side handles 18 arranged along the side edges 6 of the sheet 4 and end handles 20 arranged along the top and bottom edges 8 and 10, respectively. A pair of end handles 20 is attached to each of the top and bottom curved edges 8 and 10 of the sheet 4. Each of the end handles 20 is arranged substantially catercornered, or diagonally (crisscrossed), to an end handle on an opposite side of opposite end of the sheet. In other words, as shown in the figures, the handle 20*a* is arranged substantially diagonal to the handle 20*b* and the handle 20*c* is diagonal to the handle 20*d*.

Figure 7:
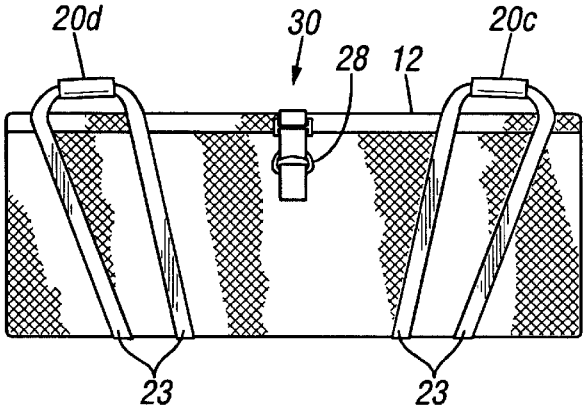
FIG. 7 is an end view of an alternative embodiment of a transporter in a fully-rolled configuration.
Figure 8:
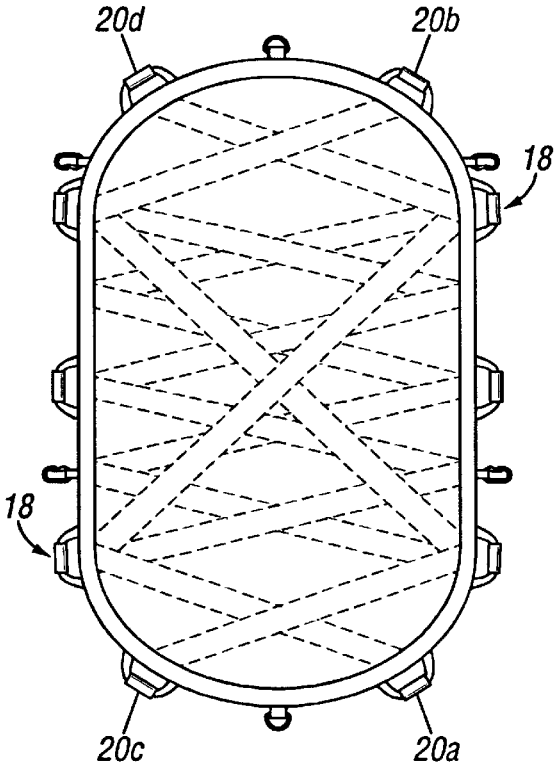
FIG. 8 illustrates a different reinforcing web layout for the transporter shown in FIG. 1.
Figure 9:
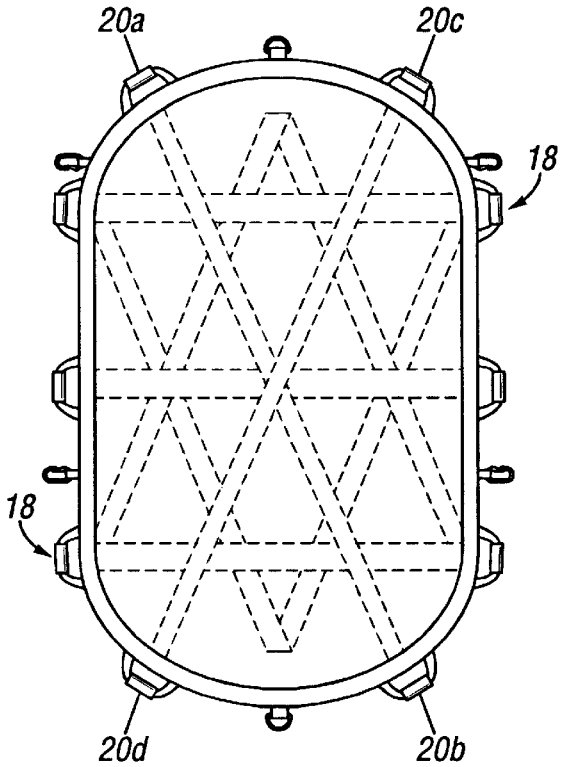
FIG. 9 illustrates another different reinforcing web layout for the transporter shown in FIG. 1.

As shown in FIGS. 1–3 and 6, a single end handle reinforcing web 22 extends diagonally across the sheet between corresponding end handles 20 for creating an "X" pattern that provides longitudinal support and enhanced load distribution for patients and carriers. Alternatively, two end handle reinforcing webs 23 may extend diagonally between pairs of end handles 20 on opposite ends of the transporter as shown in FIG. 7. In this double end handle reinforcing web configuration each end handle 20 will have a reinforcing web 22 extending from each attachment of the end handles 20 to the sheet 4. The two webs for each end handle 20 will extend, substantially parallel to each other, to the corresponding handle on the opposite side of the opposite end of the transporter 2. This double reinforcing web design permits the option of carrying extremely heavy loads, for example, loads up to and exceeding 1500 pounds. Alternatively, the end handle reinforcing webs may be arranged in a double helix pattern and/or a triple "X" pattern as shown in FIGS. 8 and 9, respectively. The double helix pattern may further include side handle reinforcing webs which are not shown in FIG. 8.

Side handle reinforcing webs 24 extend substantially parallel across the sheet to corresponding side handles 18 for providing axial support and load distribution. As with the end handle reinforcing webs 22, two side handle reinforcing webs 24 may be used for each side handle 16. In such a double side handle web configuration, the side handle reinforcing webs 24 may be parallel to each other, or webs extending between the same side handles may cross approximately half way across the width of the sheet 4. The end handle reinforcing webs 22 and side handle reinforcing webs 24 are preferably formed from two-inch wide (5000 pound test) seat-belt webbing material and secured to be bottom of the sheet 4 using monofilament or polymonofilament stitching, or other suitable means. The handle reinforcing webs 22 and 24 may be secured to one or both surfaces of a sheet 4 with stitching on one or both sides of the sheet.

The handle reinforcing webs 22 and 24 may also be integral with, or formed from the same material, as the sheet 4 and/or sandwiched between layers of material used to form the sheet 4. For example, in a preferred two-sheet ("sheet-web-sheet") embodiment, the end and side handle reinforcing webs 22 and 24 are stitched to the top surface of a bottom sheet. A smooth top sheet, without webbing or stitching, is then secured at its edges on the top surface of the bottom sheet for providing enhanced comfort for a patient lying on top of the smooth top sheet and for making the smooth sheet easier to clean. In another two-sheet ("web-sheet-sheet" or "sheet-sheet-web") embodiment, the reinforcing webs may be attached to the bottom surface of the bottom sheet for providing additional patient comfort and also preventing ground abrasion or tearing of the bottom webbed sheet. Padding material may also be provided between the two layers of sheets 4.

A plurality of rigging fasteners 26, such as clips, chocks, rings, and/or carabineers, are secured to the edges of the transporter 2 in order to create a foot pocket for securing the feet of the patient inside the sheet 4 and/or for attaching the transporter to heavy-lifting equipment. Lifting equipment or rigging to secure a patient may also be attached to the handles 18 and 20. In a preferred embodiment shown in the FIGS., one set of fasteners 26 is placed between the side edges 6 and end edges 8 on one end of the transporter 2 and also between side handles on the other end of the transporter. Closure rings or loops 28 are arranged near the apex of each of the top and bottom edges 8 and 10 of the sheet 4 for folding one or both ends of the transporter over the feet of the patient and securing both fasteners 26 to a closure ring 28 on the same end of the transporter 2. The foot pockets help prevent a patient from sliding of the end of the transporter 2. Placing the fasteners 26 at different positions around the perimeter of sheet 4 allows users to create different size foot pockets.

Figure 3:
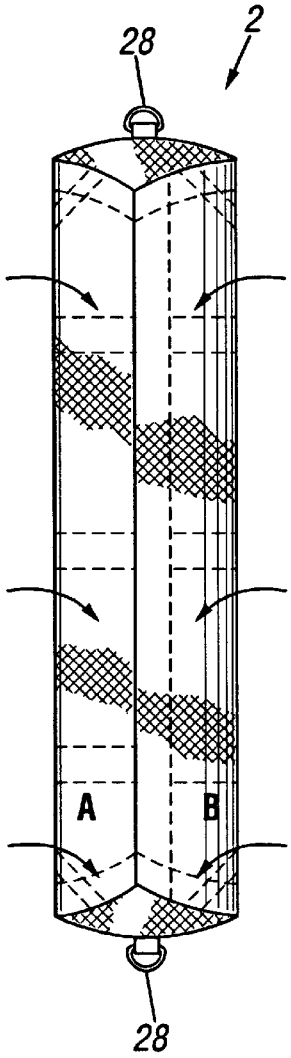
FIG. 3 is a top view of the patient transporter of FIG. 1 in a folded configuration.
Figure 4:
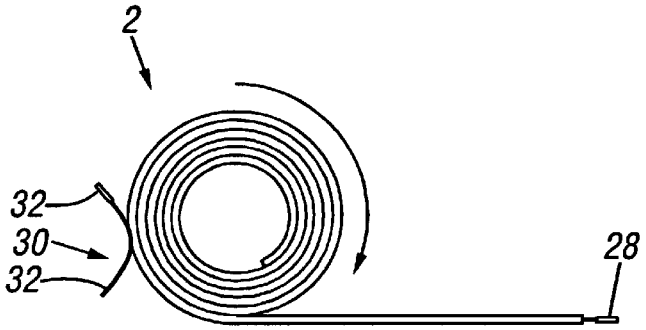
FIG. 4 is a side view of the folded patient transporter of FIG. 3 in a partially-rolled configuration.
Figure 5:
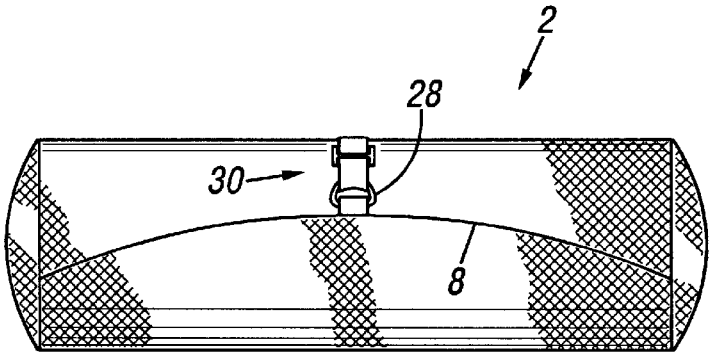
FIG. 5 is a front view of the patient transporter of FIG. 4 in a fully-rolled configuration.

Closure straps 30 on a bottom surface of the transporter 2 may be used for securing the transporter for storage in a compact bundle as discussed in more detailed below with respect to FIGS. 3–5. FIG. 3 is a top view of the patient transporter 2 of FIG. 1 shown in a folded configuration being prepared for storage. In FIG. 3, sides A and B have been folded inward toward the center of the sheet 4 where one side edge 6 may slightly overlap the opposite side edge and the handles 14 are tucked inside the folded bundle. FIG. 4 is a side view of the folded transporter 2 from FIG. 3 being rolled for storage. As shown in FIG. 4, the closure straps 30 may include mating adjustable buckles 32 at their ends. As shown in FIGS. 5 and 7, after the transporter 2 is fully-rolled, the buckles 32 on the closure straps 30 are fastened through one of the closure rings 28 in order to maintain the transporter 2 in a tightly compacted roll for storage. Alternatively, the closure straps 30 may be provided with Velcro-type fasteners or without any type of fastener for simply tying around the roll.

Figure 6:
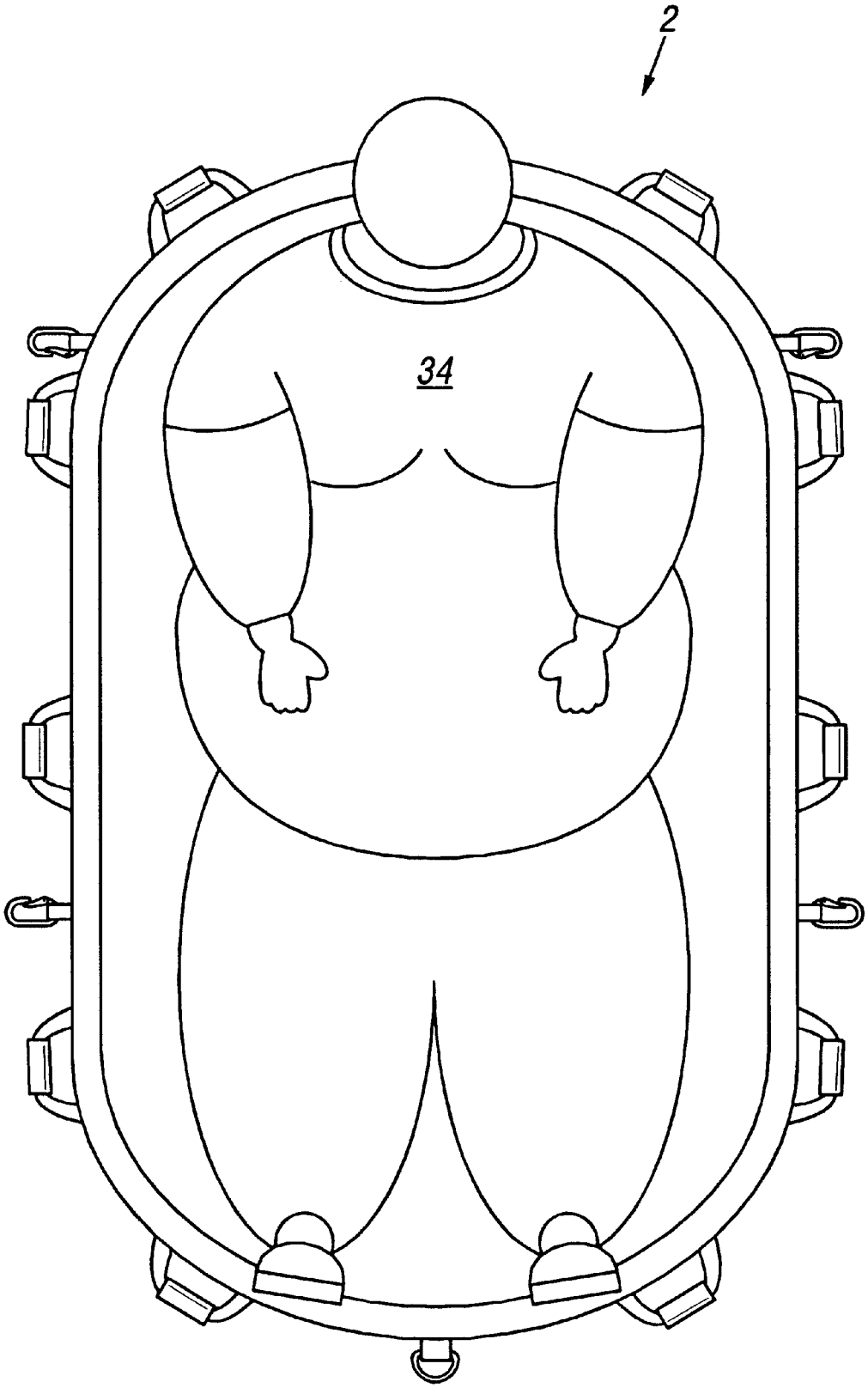
FIG. 6 is a top view of a patient on the patient transporter of FIG. 1.

FIG. 6 shows a top view of an obese patient 34 ready for transport on top of the patient transporter 2. FIG. 6 illustrates the clear peripheral view provided to the patient and even distribution of load provided by the shape of the sheet 4.

A patient transporter constructed in the manner described above is expected to support a dead load of at least 760 pounds, for over one minute without visible damage. Such transporters are useful for conveniently transporting large, obese, heavy (300–700 pounds) patients, or other loads, from small crowded rooms to stretchers or Gurneys outside the building.

While the embodiments disclosed above have been discussed with respect to certain drawings, vendors, products, and preferred configurations, this description is intended to be merely illustrative of some of the many useful forms in which the invention might be "reduced to practice," or used, by one of ordinary skill in the art. The scope of protection which has been awarded for this invention is defined by the subject matter of the following claims.

What is claimed is:

1. A flexible patient transporter, comprising:

a first sheet having two side edges with a first radius of curvature and two end edges with a second radius of curvature, said first radius of curvature being larger than said second radius of curvature;

a pair of end handles attached to each of the curved end edges of the sheet, each of said end handles arranged diagonal to an end handle on an opposite side of an opposite end of the sheet, a loop attached near an apex of at least one of the end edges, and at least one fasteners secured to each of the side edges of the sheetm said fasteners adapted to be releasably secured to at least one of the loops, to thereby form a foot pocket at an end of the sheet, which pocket would prevent a patient from sliding out of the transporter; and a pair of end handle reinforcing webs attached to said sheet extending between the end handles on one end of the sheet and corresponding end handles on an opposite side of the other end of the sheet.

2. A flexible patient transporter as claimed in claim 1 wherein said sheet includes a PVC fabric.

3. A flexible patient transporter as claimed in claim 1 wherein said pair of end handle reinforcing webs are arranged in a pattern selected from the group consisting of an X pattern, a triple X pattern, and a double helix pattern.

4. A flexible patient transporter as claimed in claim 3 wherein said reinforcing webs include seat belt webbing.

5. A flexible patient transporter as claimed in claim 1 wherein said two side edges are substantially parallel to each other.

6. A flexible patient transporter as claimed in claim 1 wherein the shape of said sheet is selected from the group consisting of oblong, oval, and elliptical.

7. A flexible patient transporter as claimed in claim 1, further comprising a second sheet secured to a surface of said first sheet and having essentially the same shape as said first sheet.

8. A flexible patient transporter as claimed in claim 1, further comprising a plurality of side handles attached to the side edges of said sheet.

9. A flexible patient transporter as claimed in claim 8 wherein each of said side and end handles includes a strap attached to said sheet at each end and threaded through a grip.

10. A flexible patient transporter as claimed in claim 1, further comprising means for reinforcing at least one edge of the sheet.

11. The flexible patient transporter as claimed in claim 1, further including closure straps attached to a surface of said sheet, said closure straps adapted to maintain said sheet in a rolled configuration.

12. A flexible patient transporter, comprising a PVC fabric sheet having two substantially parallel side edges and two substantially curved end edges;

a pair of end handles attached to each of said curved end edges of the sheet, each of said end handles arranged diagonal to an end handle on an opposite side of an opposite end of the sheet;

end handle reinforcing webs attached to and crisscrossing the sheet between end handles on opposite ends and opposite sides of the sheet, a loop attached near an apex of at least one of the end edges, and at least one fasteners secured to each of the side edges of the sheet, said fasteners adapted to be releasably secured to at least one of the loops, to thereby form a foot pocket at an end of the sheet, which pocket would prevent a patient from sliding out of the transporter;

a plurality of side handles attached to the side edges of the sheet; and side handle reinforcing webs attached to the sheet and extending between side handles across the width of the sheet.

13. A flexible patient transporter as claimed in claim 12, wherein said end handle reinforcing webs are laid out in a pattern selected from the group consisting of a an X pattern, a triple X pattern, and a double helix pattern.

14. A flexible patient transporter as claimed in claim 12, wherein said side handle reinforcing webs are substantially parallel to each other.

15. A flexible patient transporter as claimed in claim 12, further comprising a first fastener attached near an apex of at least one of the curved edges of the sheet; and a pair of second fasteners atached to edges of the sheet and equally spaced on either side of said first fastener for connecting with said first fastener and forming a foot pocket at one end of the sheet.

16. A flexible patient transporter as claimed in claim 12, wherein each of said handles includes a hollow grip; and a strap extending through said grip and attached at each end to an edge of said sheet.

17. A flexible patient transporter as claimed in claim 12, wherein said webs include seat belt webbing attached to said sheet with monofilament stitching.

18. A flexible patient transporter as claimed in claim 12, wherein said sheet is at least seven feet long and three and a half feet wide.

19. A flexible patient transporter as claimed in claim 18, wherein said sheet has a length to width ratio of 2 to 1.

20. A flexible patient transporter, comprising:

a PVC fabric sheet having two substantially parallel side edges and two substantially curved end edges;

an edge reinforcing web attached to the sheet and extending substantially around all edges of the sheet;

a pair of end handles attached to each of said curved end edges of the sheet, each of said end handles arranged diagonal to an end handle on an opposite side of an opposite end of the sheet end handle reinforcing webs crisscrossing the sheet between end handles on opposite ends and opposite sides of the sheet;

a plurality of side handle s attached to the side edges of the sheet;

side handle reinforcing webs attached to the sheet and extending substantially parallel to each other between each side handle on one side edge of the sheet and another side handle on the opposite side edge of the sheet;

each of said handles including a hollow grip and a strap extending through said grip wherein the strap is attached at each end to an edge of said sheet;

a loop attached near an apex of each of the end edges of the sheet;

and a pair of spaced apart fasteners secured to the side edges of the sheet, some of said fasteners adapted to be releasably secured to one of the loops, to thereby form a foot pocket at an end of the sheet, which pocket would prevent a patient from sliding out of the transporter.

* * * * *